US006581520B1

(12) United States Patent
Koch et al.

(10) Patent No.: US 6,581,520 B1
(45) Date of Patent: Jun. 24, 2003

(54) PYROTECHNIC ACTIVE MASS FOR PRODUCING AN AEROSOL HIGHLY EMISSIVE IN THE INFRARED SPECTRUM AND INPENETRABLE IN THE VISIBLE SPECTRUM

(75) Inventors: Ernst-Christian Koch, Kaiserslautern (DE); Axel Dochnahl, Remstein (DE)

(73) Assignee: Pepete GmbH, Hanau (DE)

( * ) Notice: Subject to any disclaimer, the term of this patent is extended or adjusted under 35 U.S.C. 154(b) by 0 days.

(21) Appl. No.: 09/937,619

(22) PCT Filed: Jan. 24, 2000

(86) PCT No.: PCT/EP00/00498

§ 371 (c)(1),
(2), (4) Date: Sep. 27, 2001

(87) PCT Pub. No.: WO00/58237

PCT Pub. Date: Oct. 5, 2000

(30) Foreign Application Priority Data

Mar. 27, 1999 (DE) ..... 199 14 097

(51) Int. Cl.[7] ..... F42B 12/48
(52) U.S. Cl. ..... 102/336; 102/334
(58) Field of Search ..... 102/334, 336

(56) References Cited

U.S. PATENT DOCUMENTS 3,730,093 A * 5/1973 Cummings ..... 102/6
4,015,355 A * 4/1977 Schiessl et al. ..... 42/1 F
4,474,715 A * 10/1984 Weber et al. ..... 264/3 C
4,534,810 A 8/1985 Knapp
4,697,521 A 10/1987 Espagnacq et al. ..... 102/334
5,389,308 A * 2/1995 Busel et al. ..... 252/587
5,635,666 A * 6/1997 Bannasch et al. ..... 102/334
5,834,680 A * 11/1998 Nielson et al. ..... 102/336
6,427,599 B1 * 8/2002 Posson et al. ..... 102/336

FOREIGN PATENT DOCUMENTS

| | | |
|---|---|---|
| DE | 28 19 850 | 7/1979 |
| DE | 301 646 | 5/1993 |
| DE | 40 30 430 | 12/1993 |
| DE | 33 26 884 | 5/1994 |
| EP | 0 106 334 | 4/1984 |
| GB | 2 206 343 | 1/1989 |
| GB | 2 218 414 | 11/1989 |

* cited by examiner

*Primary Examiner*—Peter A. Nelson
(74) *Attorney, Agent, or Firm*—Foley & Lardner

(57) ABSTRACT

The invention relates to a pyrotechnic active mass which is impenetrable in the visible spectrum, highly emissive in the infrared spectrum and used for camouflage and decoy purposes. As principal ingredients said mass contains red phosphorus and an alkali metal nitrate or mixture of alkali metal nitrates and as secondary ingredients at least one transition metal or a metal-rich compound or alloy thereof, at least one metalloid and a binder.

5 Claims, 1 Drawing Sheet

Figure 1:
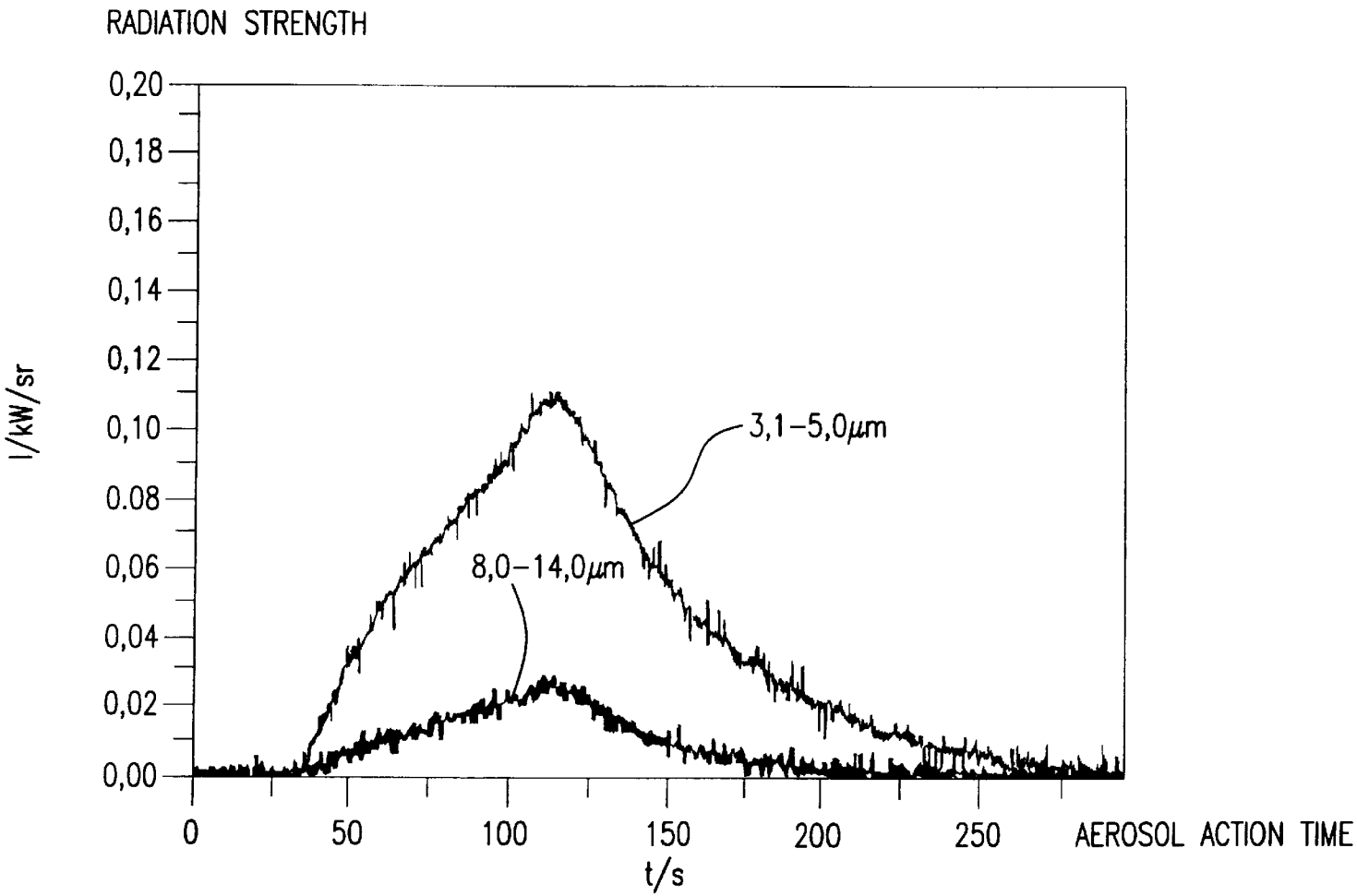

PYROTECHNIC ACTIVE MASS FOR PRODUCING AN AEROSOL HIGHLY EMISSIVE IN THE INFRARED SPECTRUM AND INPENETRABLE IN THE VISIBLE SPECTRUM

The subject of the present invention is a human and ecotoxicologically compatible pyrotechnic active mass consisting of red phosphorus, a metallic fuel from the group of the transition metals, preferably titanium, zirconium or iron, a moderator of the group of the metalloids boron end silicon, an oxidation agent of the group of the alkali metal nitrates, preferably caesium nitrate and potassium nitrate which is suitable for the production of an aerosol highly emissive in the infrared (3–5, 8–14 $\mu$m) and impenetrable in the visual spectrum.

Pyrotechnically produced aerosols are today preponderantly used in the military field for camouflaging, decoying, screening, simulating and marking.

Whereas for the cases of use marking and simulating there are preferably used coloured aerosols based on organic azo dyestuffs (white, orange, red, violet, green, blue) which only absorb in the visible range of the spectrum, for camouflaging, decoying and screening one preferably uses aerosols which also interupt in the infrared range of the electromagnetic spectrum, especially in the range of the atmospheric transmission windows at 0.3–1.5; 1.6–1.8; 2.0–2.5; 3.0–5.0 and 8.0–14 $\mu$m, by various mechanisms. To these mechanisms count the scattering, absorption and emission of radiation.

Scattering and absorption of radiation are described by the Lambert-Beer Law $$l=l_o\exp^{-\alpha cl} \tag{1}$$

whereby l describes the radiation intensity weakened by the reciprocal action, $l_o$ represents the initial intensity, c corresponds to the concentration of the aerosol per volume unit, l is the path length through the aerosol cloud of assumed isotropic density, $\alpha$ is the wavelength-dependent mass extinction coefficient of the aerosol particles which, in the case of a given material, is made up as sum of the scattering and absorption coefficients:

$$\alpha(\lambda)=\alpha_{scat}(\lambda)+\alpha_{abs}(\lambda) \tag{2}$$

Whereas the scattering action preponderantly depends on the particle morphology and size of the particles, the absorption is only determined by the chemical composition of the particles. Only the index of refraction m of an aerosol, which is determined not only by the physical but also the chemical properties, influences not only the scattering but also the absorption behaviour.

In order that aerosols can scatter radiation, according to Rayleigh the particle diameter, in the case of assumed spherical morphology of the particles, and the wavelength of the radiation to be scattered must be identical. This means that for an optimum scattering of radiation in the micrometer range, particles with particle diameters of 0.3–14 $\mu$m must be present.

Such particles can be produced in established way by the following processes:

a) combustion of oxygen-deficient, carbon-rich pyrotechnic batches. Then, in the case of the burning, on the basis of the poor oxygen balance, there results much carbon black with particle diameters in the relevant size range (DD 301 646 A7, DE 3326884 C2).

b) explosive dissimination of pre-produced particles, preferably brass dust in the suitable size range.

The aerosols described under a) and b) contribute to the absorption of infrared radiation due to their chemical composition. Not only carbon black but also brass dust are electrically conductive and are, therefore, suitable for the decoupling of infrared radiation.

The disadvantages of the above-described methods for the production of infrared radiation-screening aerosol clouds consist in a) in the contamination of the carbon black particles produced with in part cancerogenic polyaromatic hydrocarbons (PAH) and, in the case of energetic halogen-containing components in such pyrotechnic batches, in the contamination of the carbon black particles with polyhalogenated oxyarenes, such as e.g. polyhalodibenzo-furans and polyhalodibenzodioxines or also polyhalogenated biphenylene, In the case of the explosive dispersion of preprepared particles, it always results in so-called bird nesting. By this one understands the hole brought about by the explosive process in the aerosol cloud with very low particle density. At this place of the cloud, the line of sight (LOS) is Dot blocked. Furthermore, the brass dust sinks very quickly to the ground so that only unsatisfactory covering times are achieved. The toxic effects of brass dust on humans and the environment are also very considerable so that a large-scale use must be dispensed with especially also for exercise purposes.

In DE 40 30 430, an active mass is described which is produced by a coordinated amount ratio of magnesium powder, a fluoridised organic polymer, chloroparaffin and an aromatic compound, especially anthracene or phthalic acid anhydride which react to polyaromatics which as voluminous agglomerates with fibrous structure, have diameters in the range of 1–20 $\mu$m which are suitable for the IR radiation scattering and absorption and, nevertheless, because of the great specific surface, float in the air. In order to suppress the formation of finely-divided carbon black instead of polyaromatics, a burning speed of about 15 g/sec must be maintained so that the covering action only starts relatively late. Therefore, in this Patent it is further suggested to add thereto a rapidly burning mixture of fluorine-containing polymer, magnesium powder and an organic binder which, for a short time, in the case of the burning produces a strong IR emission and thus closes the initial covering holes.

Disadvantageous in the case of this process is that the polyaromatics formed also still contain cancerogenic substances and the emissive action subsides very quickly because of the use of magnesium.

The main problem of conventional impermeable aerosols of the above-described type consists in the ineffectiveness effectively to protect moving warm targets (humans, vehicles, armoured platforms) against CLOS and SACLOS missiles (e.g. Milan, TOW etc.). These missiles are controlled by means of wires or glass fibres by a controller which aims at the target via a heat image device (8–14 $\mu$m). After target pick-up has taken place, a controller can estimate the approximate position from the last observed movement and, through the transmission holes typically found in aerosol clouds, further follow the emissive target and direct the missile into the target.

It was, therefore, the task of the present invention to develop a camouflage smoke screen which, besides the impenetrability in the visible range, also makes possible a long-lasting covering in the IR range.

The solution of this task is achieved by the features of the main claim and promoted by the subsidiary claims.

The smoke screens according to the invention contain, as main components, red phosphorus, an alkali metal nitrate, for example lithium nitrate, sodium nitrate, potassium nitrate, rubidium nitrate and caesium nitrate or a mixture thereof, as well as, as subsidiary components, a metallic fuel from the group of the transition metals, such as for example titanium, zirconium or iron, or a metal-rich alloy or compound of these elements, such as for example TiH, Zr/Ni, Zr/Fe or $ZrSi_2$, at least one metalloid, such as for example boron or silicon or an electron-donating compound of these elements, as well as a polymeric organic binder.

That red phosphorus serves as carrier of the transmission-dampening action in the visible range was long known but, on the other hand, the knowledge is new that red phosphorus, under certain circumstances, also sets as carrier of the emissive action in the infrared range. The red phosphorus is, in the case of the reaction of the energetic components nitrate/metal/metalloid, substantially evaporated (equation s) and burns in the presence of atmospheric oxygen according to equation (4) to give phosphorus pentoxide.

$$P_{(red)}+\text{heat of combustion}\rightarrow P_{4(g)} \quad (3)$$

$$P_{4(g)}+5O_2\rightarrow 2P_2O_5+\text{heat} \quad (4)$$

Phosphorus pentoxide reacts with atmospheric moisture according to equation 5 to give phosphoric acid $$P_2O_5+3H_2O\rightarrow 2H_3PO_4+\text{heat} \quad (5)$$

The use according to the invention of alkali metal nitrates as oxidation agent gives, in the case of combustion, alkali metal oxides which, in the presence of atmospheric moisture, react off according to equation 6 to give the hydroxides.

$$M_2O_{(s)}=H_2O\rightarrow 2MOH_{(aq)}+\text{heat} \quad (6)$$

These arosol droplets give with the phosphoric acid droplets, in a strongly exothermal reaction, the corresponding dihydrogen phosphates.

$$MOH+H_3PO_{4(aq)}\rightarrow 2MH_2PO_4+H_2O+\text{heat} \quad (7)$$

The hydrating of the dihydrogen phosphates is also an exothermal reaction and again gives heat.

$$MH_2PO_4+n\ H_2O\rightarrow MH_2PO_4\cdot(H_2O)_n+\text{heat} \quad (8)$$

The aerosol droplets formed possess a size of 0.01–2 $\mu$m and thereby a high adsorption and dispersion coefficient in the visible and short-wave infrared range of 0.3–1.9 $\mu$m and low damping values in the middle and long wave infrared of 2–14 $\mu$m. Undamaged thereby, the heat formed by the reactions 4–6 and especially in the steps 7 and 8 provides for a strong emission of the aerosol droplets in the medium and long waved infrared and thus compensates the low scattering and absorption coefficients in this spectral range. In contradistinction to the known strong emission of magnesium-containing active masses which occurs directly in the case of the combustion and thereafter subsides quickly, the heat development according to the invention occurs partly by chemical processes which first become possible by the delayed formation taking place of the aerosol droplets so that this emissive action is maintained for 50–200 sec., i.e. the time necessary for a camouflaging.

Due to the use according to the invention of transition metals the oxides of which have high heats of formation, such as for example zirconium and titanium, as well as of metalloids, such as boron and/or silicon, very high combustion temperatures are achieved, therefore the aerosol particles maintain a high thermal energy which increases the emission in the longwaved IR.

Furthermore, the use according to the invention of the transition metals and their alloys or metal-rich compounds suppresses the formation of phosphane formers. The metal phosphides (e.g. zirconium phosphide or titanium phosphide) formed due to the oxygen underbalancing possess a non-ionic character, for which reason no hydrolysis or acidolysis with the liberation of phosphanes takes place with atmospheric moisture or acidic rain.

Therefore, smoke screens produced according to the invention are human and ecotoxocologically compatible and considerably, safer than conventional smoke screens based on red phosphorus and light metal, such as for example magnesium or aluminium. The self-ignition of the combustion residues typically occurring in the case of smoke screens based on red phosphorus is thus also no longer given.

The following Example is to explain the invention without limiting it thereto:

EXAMPLE

From 2750 g red phosphorus, 990 g potassium nitrate, 220 g silicon, 220 g boron, 220 g zirconium and 990 g macroplast binder (30% solid bodies) is produced a pasty batch by stepwise addition of the components to the red phosphorus. The solvent-moist mass is sieved (7 mm mesh width) and dried for 20 minutes in a vacuum at 40° C. and 20 mbar. The 42 g of granulate are pressed with a moulding pressure of 20 tonnes into ring-shaped pressed bodies. of 10 mm edge height, 57 mm external diameter and 15 mm internal diameter. A tablet possesses 8 burning time of about 35 seconds and in visual light produces a thick white smoke.

A radiometric measurement of the resulting aerosol at 4 m distance from the source discloses the following radiation strengths in the infrared range;

| band V (8–14 $\mu$m) | Band II (3–5 $\mu$m) |
|---|---|
| >100 W/sr > 25 s | >20 W/sr > 25 s |
| >60 W/sr > 75 s | >10 W/sr > 75 s. |

FIG. 1 shows the radiation strengths of the aerosol clouds which are produced by combustion of a pressed body of the weight 120 g produced according to the invention at 5 m distance from the source. With the aerosol clouds produced according to the invention, there is achieved a very good irradiation (>95%) of emissive targets, the colour temperature reaches 300° C.

What is claimed is:

1. A pyrotechnic active mass for camouflaging and decoy purposes which is impenetrable in visible light and strongly emissive in infrared light, comprising, as main components, 45% to 75% red phosphorus and 15% to 35% of alkali metal nitrate or a mixture of alkali metal nitrates, as subsidiary components, 2% to 20% of at least one transition metal or a metal-rich compound or an alloy thereof and at least one metalloid, and 0.5% to 8% of a binder.

2. The pyrotechnic active mass of claim 1, which, upon reaction, forms aerosol droplets.

3. The pyrotechnic active mass according to claim 1, comprising 55% to 62% red phosphorus, 18% to 23% alkali metal nitrates, 10 to 18% metals or metalloids and 5 to 7% binder.

4. The pyrotechnic active mass according to claim 1, comprising 58.5% red phosphorus, 21.1% potassium nitrate, 4.7% each of boron, silicon and zirconium, and 6.3% of a polychloroprene binder.

5. The pyrotechnic active mass of claim 2, wherein said aerosol droplets are 0.3 to 14 $\mu$m in size.

* * * * *